US006743060B2

(12) United States Patent
Wu

(10) Patent No.: US 6,743,060 B2
(45) Date of Patent: Jun. 1, 2004

(54) ELECTRICAL CONNECTOR

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/191,609

(22) Filed: Jul. 8, 2002

(65) Prior Publication Data

US 2004/0005795 A1 Jan. 8, 2004

(51) Int. Cl.[7] ..... H01R 13/415
(52) U.S. Cl. ..... 439/741; 439/660
(58) Field of Search ..... 439/84, 741, 660, 439/746, 743, 871, 872, 943

(56) References Cited

U.S. PATENT DOCUMENTS 5,314,358 A * 5/1994 Klemmer et al. ..... 439/741
5,639,269 A * 6/1997 Vanbesien et al. ..... 439/741
2002/0061683 A1 * 5/2002 Fukui ..... 439/660

* cited by examiner

*Primary Examiner*—Khiem Nguyen
(74) *Attorney, Agent, or Firm*—Wei Te Chung

(57) ABSTRACT

An electrical connector (1) comprises a dielectric body (10) and a plurality of conductive contacts (20) retained to the dielectric body. The dielectric body defines two rows of positioning holes (11) and a row of retaining holes (13) between the positioning holes. Each contact has a retaining portion (22) retained to a corresponding retaining hole, a mating beam (24) and a press-fit tail (26) extending from opposite ends of the retaining portion. A pair of resilient beams (28) project from a joint portion between the retaining portion and the press-fit tail for insertion into a corresponding positioning hole and upper ends (282) thereof are bent to abut against a slanted portion (114) formed adjacent to the positioning hole.

21 Claims, 6 Drawing Sheets

ELECTRICAL CONNECTOR

BACKGROUND OF THE INVENTION

1. Field of the Invention

The present invention relates to an electrical connector, and particularly to an electrical connector having improved press-fit conductive contacts which can be securely and reliably retained to a housing of the electrical connector.

2. Description of Related Art

With the development of computer technology, a new product, named as a serial ATA (Advance Technology Attachment) electrical connector, is proposed for use as an interface of fast-talking drives, which will effectively improve the bandwidth, or capacity for data, between hard disk drives and other PC components, with respect to the parallel ATA connector. The serial ATA connector also has some other improvements with respect to the parallel ATA, such as low cost, low pin count, and low voltage requirement, and so on. In a word, the serial ATA connector provides a long-term solution for high performance, and easier, more flexible system design.

Commonly, a serial ATA connector mounted on a circuit board includes an insulative housing and a plurality of signal, power and ground contacts retained in the housing. For simplifying the connection or disconnection of the serial ATA connector from the circuit board, the conductive contacts thereof are provided with press-fit tails to be directly inserted into or withdrawn from corresponding holes defined in the circuit board, which needs relative large insertion or withdrawal force during insertion or withdrawal from the circuit board. The large insertion/withdrawal force causes the contacts to separate from the housing, if the conductive contacts are not securely retained to the housing.

Hence, a serial ATA connector with improved press-fit contacts is desired to resolve the above-mentioned problems or disadvantages.

BRIEF SUMMARY OF THE INVENTION

A main object of the present invention is to provide an electrical connector having improved press-fit contacts which can be prevented from moving with respect to a dielectric body of the electrical connector or being damaged during assembly.

To fulfill the above-mentioned object, an electrical connector in accordance with the present invention comprises a dielectric body and a plurality of conductive contacts retained to the dielectric body. The dielectric body defines two rows of positioning holes and a row of retaining holes between the positioning holes. Each contact has a retaining portion retained to a corresponding retaining hole, a mating beam and a press-fit or complaint type tail extending from opposite ends of the retaining portion. A pair of resilient beams project from a joint portion between the retaining portion and the press-fit tail for insertion into a corresponding positioning hole, and upper ends of the resilient beams abut against a slanted portion formed adjacent to the positioning hole.

Other objects, advantages and novel features of the invention will become more apparent from the following detailed description of the present embodiment when taken in conjunction with the accompanying drawings.

DETAILED DESCRIPTION OF THE INVENTION

Figure 1:
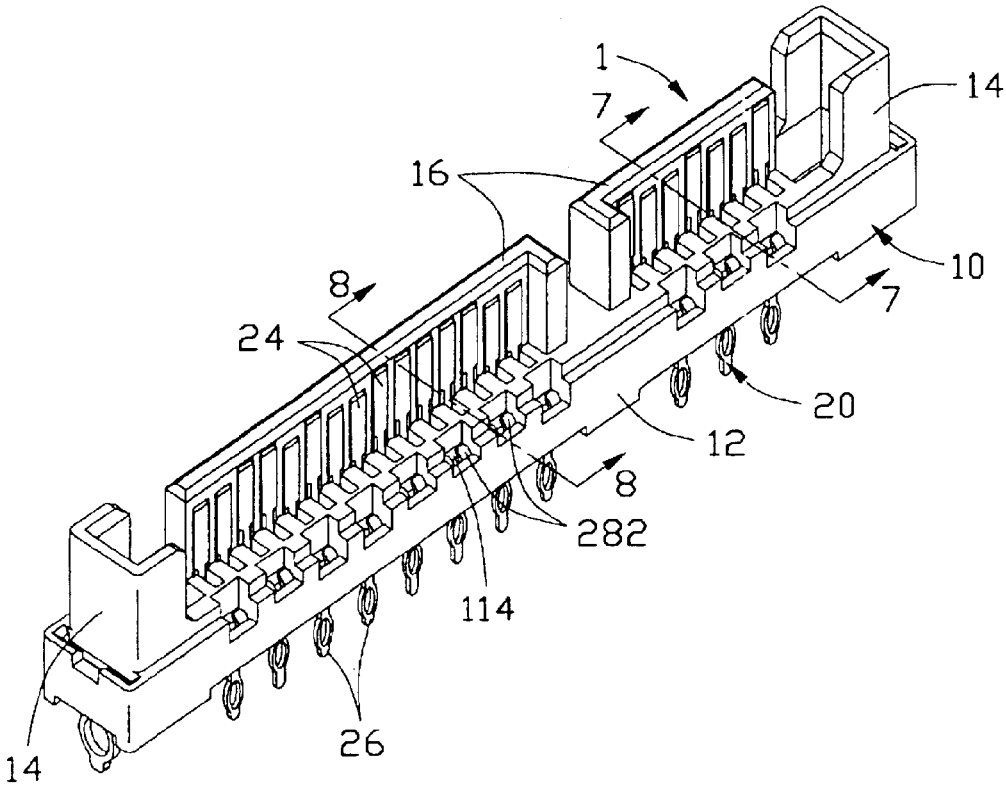
FIG. 1 is a perspective view of an electrical connector in accordance with the present invention.

Reference will now be made to drawings and particularly to FIG. 1, an electrical connector 1, named as a serial ATA connector, for being mounted on a backplane or a circuit board (not shown) in accordance with the present invention, comprises an elongated dielectric body 10 and a plurality of conductive contacts 20 retained in the dielectric body 10.

Figure 2:
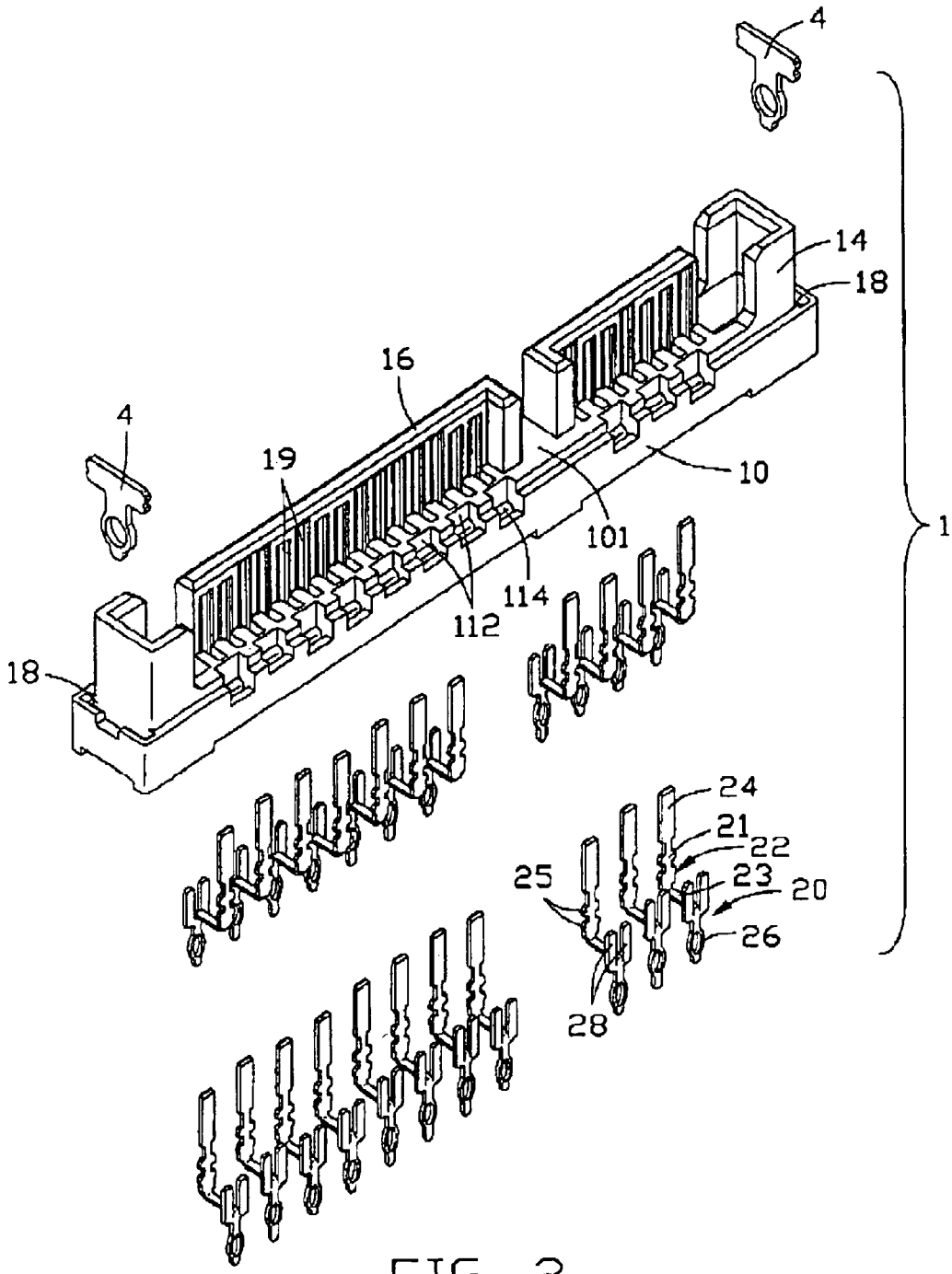
FIG. 2 is an exploded perspective view of FIG. 1.
Figure 3:
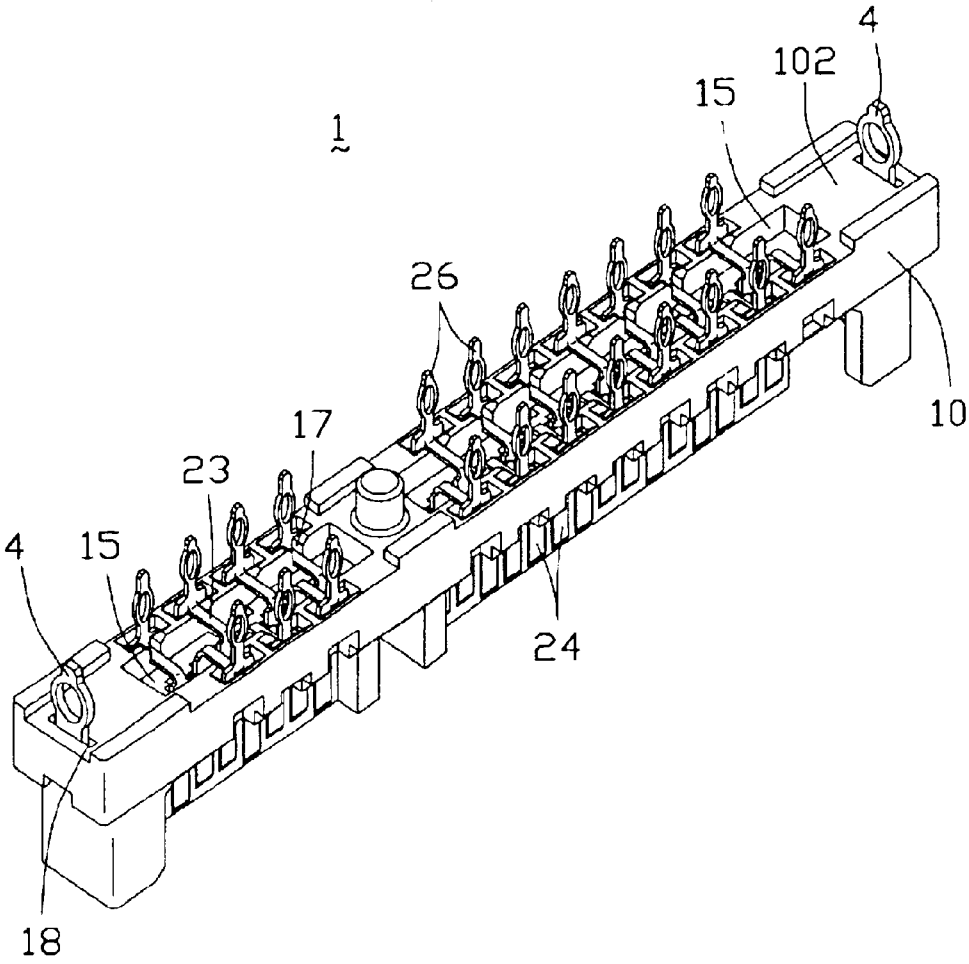
FIG. 3 is a view similar to FIG. 1 from a bottom aspect.
Figure 4:
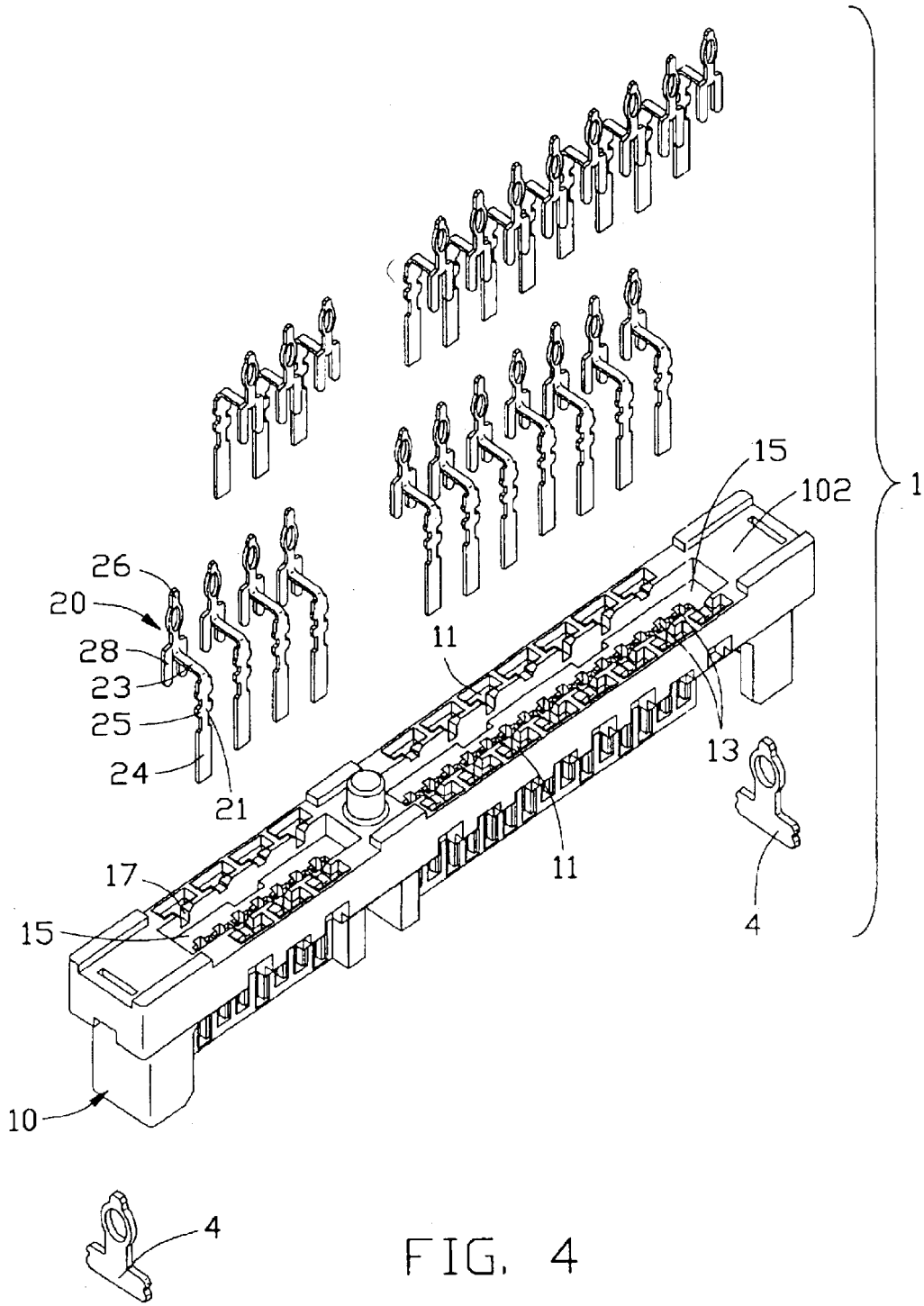
FIG. 4 is an exploded perspective view of FIG. 3.
Figure 5:
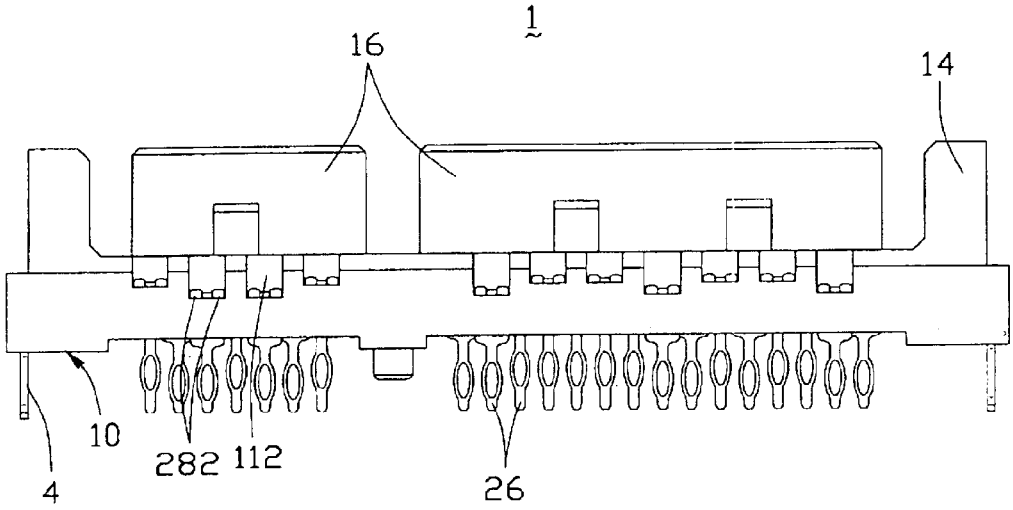
FIG. 5 is a rear view of FIG. 1.
Figure 6:
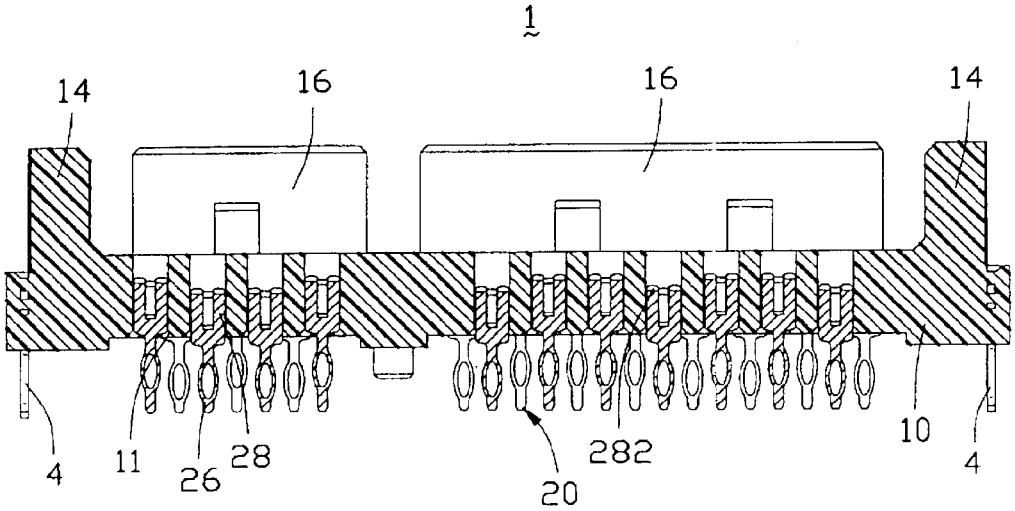
FIG. 6 is a cross-sectional view of FIG. 5.
Figure 7:
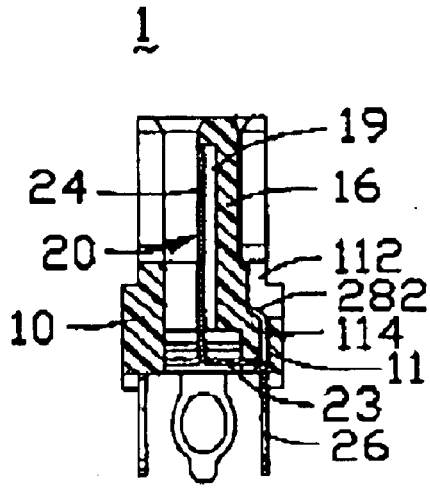
FIG. 7 is a cross-sectional view taken along line 7—7 of FIG. 1.
Figure 8:
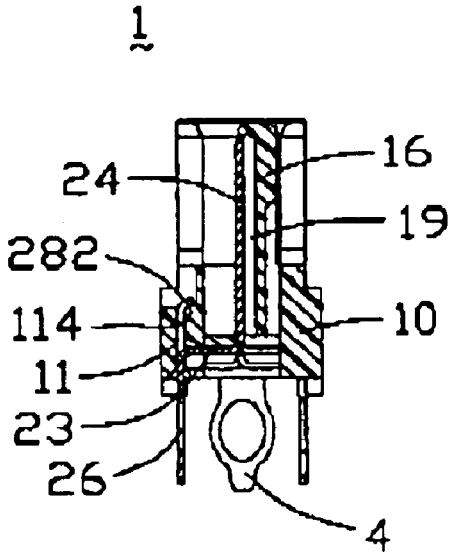
FIG. 8 is a cross-sectional view of taken along line 8—8 of FIG. 1.

Further referring to FIGS. 2 to 4, the dielectric body 10 has a base portion 12, a pair of short and long tongues 16 projecting upward from a top face 101 of the base portion 12, and a pair of end portions 14 extending upward from opposite ends of the base portion 12. As best seen in FIGS. 4 and 5, the base portion 12 defines two rows of positioning holes 11 extending through opposite top and bottom faces 101, 102 thereof for receiving corresponding contacts 20. The bottom face 102 of the electrical body 10 further defines a pair of short and long slots 15 between the two rows of positioning holes 11, aligned with the short and long tongues 16, respectively. A row of retaining holes 13 is defined beneath and communicated with corresponding long and short slots 15 and the number thereof is equal to that of the two rows of the positioning holes 11 in accordance with the preferred embodiment of the present invention. Additionally, a notch 17 is defined beside and communicated with each positioning hole 11. The notch 17 is defined in the bottom face 102 of the dielectric body 10. Back to FIG. 1, two rows of enlarged recesses 112 are defined in the top face 101 of the base portion 12 and each recess 112 are corresponds to and communicates with one positioning hole 11. A slanted portion 114 is formed in each enlarged recess 112 and adjacent to the associated positioning hole 11, as best seen in FIGS. 7 and 8. Each of the long and short tongues 16 defines a plurality of positioning slits 19 on exterior surfaces thereof for positioning corresponding contacts 20, and each positioning slit 19 is aligned and communicated with a corresponding retaining hole 13 therebelow. Furthermore, a pair of through slits 18 are defined outside the end portions 14 for receiving a pair of retaining mechanisms 4 to thereby retain the electrical connector 1 to the backplane or the circuit board.

The conductive contacts 20 all have the same structure as mentioned above, except that some of them are relatively higher than the others. The higher contacts 20 are adopted for transmitting power and providing grounding function between two electronic devices (not shown), while the other relatively lower contacts 20 are used for transmitting signals between the two electronic devices. Each contact 20 has a retaining portion 22, a planar mating beam 24 and a press-fit tail 26 extending from opposite ends of the retaining portion 22. The retaining portion 22 has an "L" shape and comprises a vertical section 21 connected to the mating beam 24 and a horizontal section 23 connected to the press-fit tail 26. The vertical section 21 forms several barbs 25 on opposite sides thereof for retaining to a corresponding retaining hole 13 of the dielectric body 10. Additionally, a pair of retaining beams 28, perpendicular to the horizontal section 23, project upward from a joint portion between the horizontal section 23 and the press-fit tail 26 for insertion into a corresponding positioning hole 11 of the dielectric body 10.

In assembly, further referring to FIGS. 5 to 8, the two rows of the conductive contacts 20 are first retained to the dielectric body 10 from the underside of the body 10. The mating beams 24 of the two rows of contacts 20 are staggeredly inserted through corresponding retaining holes 13 into the communicated positioning slit 19, and the vertical sections 21 of the retaining portions 22 are thus retained to the corresponding positioning holes 13.

In this way, on one hand, when the contacts 20 are inserted into corresponding holes (not shown) of the backplane or the circuit board by a relatively large insertion force, due to the horizontal sections 23 which abut against the bottom face 102 of the dielectric body 10, an upward pushing force acting on the contacts 20 can be effectively resisted by the dielectric body 10; thus, the upward pushing force will not cause the contacts 20 to separate from the dielectric body 10. One the other hand, when the contacts 20 are pulled to separate from the backplane or the circuit board by a relatively large withdrawal force, due to the upper ends 282 which abut against the slanted portions 114 of the dielectric body 10, a downward pulling force acting on the contacts 20 is effectively resisted by the dielectric body 10; thus the downward pulling force will not causes the contacts 20 to separate from dielectric body 10. Thus, the conductive contacts 20 in accordance with the present invention are always securely retained in the dielectric body 10 during the mounting/dismounting of the connector 1 to/from the backplane or the circuit board in which the connector 1 has the press-fit contacts 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric body defining two rows of positioning holes and a row of retaining holes between the positioning holes; and a plurality of conductive contacts each having a retaining portion retained to a corresponding retaining hole, a mating beam and a press-fit tail extending from opposite ends of the retaining portion, respectively, a pair of resilient beams projecting from a joint portion between the retaining portion and the press-fit tail, the pair of resilient beams being inserted into a corresponding positioning hole.

2. The electrical connector as claimed in claim 1, wherein the dielectric body comprises a base portion, a pair of long and short tongues projecting from the base portion and a pair of end portions extending from opposite ends of the base portion.

3. The electrical connector as claimed in claim 2, wherein the base portion of the dielectric body defines in a bottom face thereof a pair of long and short slots aligned with the long and short tongues, respectively.

4. The electrical connector as claimed in claim 3, wherein the retaining holes are beneath and communicated with the long and short slots.

5. The electrical connector as claimed in claim 1, wherein the number of the retaining holes is equal to that of the two rows of positioning holes.

6. The electrical connector as claimed in claim 4, wherein the dielectric body defines in the bottom face thereof two rows of notches and each notch is communicated with a corresponding positioning hole.

7. The electrical connector as claimed in claim 2, wherein two rows of enlarged recesses are defined in a top face of the base portion, each enlarged recess being communicatively positioned above a corresponding position hole.

8. The electrical connector as claimed in claim 7, wherein a slanted portion is formed in each enlarged recess and wherein an upper end of each contact is bent to abut against the slanted portion.

9. The electrical connector as claimed in claim 2, wherein the long and the short tongues define a plurality of positioning slits, the positioning slits receiving corresponding mating beams of the conductive contacts, and each positioning slit is aligned and communicated with a corresponding retaining hole.

10. The electrical connector as claimed in claim 6, wherein the retaining portion of the contact has an "L" shape and has a vertical section forming several barbs retained into a corresponding retaining hole of the dielectric body and a horizontal section interferingly engaged with a corresponding notch in a bottom face of the dielectric body.

11. The electrical connector as claimed in claim 1 further comprising a retaining mechanism retained to the dielectric body, the retaining mechanism being adapted for retaining the electrical connector to a circuit board.

12. An electrical connector for being mounted onto a circuit board, comprising:

a dielectric body defining two rows of positioning holes and a row of retaining holes between the positioning holes; and a plurality of conductive contacts each having a retaining portion retained to a corresponding retaining hole, a mating beam and a press-fit tail extending from opposite ends of the retaining portion; wherein a horizontal section is formed on each of the conductive contacts to prevent the contact from moving with respect to the dielectric body or being damaged during the contact inserting into a circuit board.

13. The electric connector as claimed in claim 12, wherein the dielectric body defines in a top face thereof two rows of enlarged recesses communicated with corresponding positioning holes and a slanted portion is formed in each enlarged recess and adjacent the positioning hole.

14. The electrical connector as described in claim 13, wherein the dielectric body defines in a bottom face thereof two rows of notches and each notch is communicated with a corresponding positioning hole.

15. The electrical connector as described in claim 14, wherein the retaining portion of the contact has an "L" shape and has a vertical section forming several barbs retained to a corresponding retaining hole of the dielectric body and the horizontal section connected to the press-fit tail.

16. The electrical connector as claimed in claim 15, wherein the horizontal section is interferingly fitted into a corresponding notch and a pair of resilient beams are formed on a joint portion between the horizontal section and the press-fit tail for insertion into a corresponding positioning hole.

17. The electrical connector as claimed in claim 16, wherein each resilient beam forms an upper end which is bent to abut against the slant surface adjacent to the corresponding positioning hole.

18. An electrical connector assembly comprising:

a printed circuit board defining at least one row of vertical through holes; and an electrical connector including:

an insulative housing defining at least one row of vertical positioning holes;

at least one row of contacts vertically inserted into and disposed in said one row of positioning holes, respectively, each of said contacts including a press-fit tail removeably retained in the corresponding through hole; wherein said press-fit tail defines a vertical plane, and each of said contacts including a lower horizontal portion and an upper horizontal portion respectively abutting against the housing vertically around said vertical plane so as to efficiently resist insertion or withdrawal force applied to the contact when said connector is mounted unto or removed from the printed circuit board; wherein both said lower horizontal portion and said upper horizontal portion extend from said vertical plane; wherein each of said contacts further includes a vertical mating beam laterally offset from the vertical plane.

19. The assembly as claimed in claim 18, wherein one of said upper and lower horizontal portions is successively horizontally bent to abut against the housing after the contact is inserted into the housing.

20. The assembly as claimed in claim 18, wherein retention means is provided around the mating beam.

21. A method of making an electrical connector for use with a printed board, comprising of steps of:

providing an insulative housing with a plurality of vertical positioning holes and a plurality of retaining hole;

providing a plurality of contacts each with a mating beam and an opposite solderless press-fit tail defining a vertical plane thereof:

inserting the mating beams of said contacts into the corresponding retaining holes, respectively, with a horizontal portion of each of the contacts vertically abutting against the housing; and successively laterally bending a portion of said press-fit tail to have said portion vertically abut against the housing; wherein said horizontal portion and said successively laterally bent portion respectively resist upward and downward force applied on the contact when said connector is used to be mounted unto or withdrawn from the printed circuit board.

* * * * *